US005371432A

United States Patent [19]

Park et al.

[11] Patent Number: 5,371,432

[45] Date of Patent: Dec. 6, 1994

[54] DUST COLLECTOR IN A CATHODE RAY TUBE

[75] Inventors: Myoung Ho Park; Cheol Ho Whang, both of Kumi, Rep. of Korea

[73] Assignee: Gold Star Co., Ltd., Seoul, Rep. of Korea

[21] Appl. No.: 889,968

[22] Filed: May 29, 1992

[30] Foreign Application Priority Data

May 30, 1991 [KR] Rep. of Korea ..... 19918949

[51] Int. Cl.[5] ..... H01J 29/50

[52] U.S. Cl. ..... 313/449; 313/451

[58] Field of Search ..... 313/415, 416, 417, 449, 313/451, 456

[56] References Cited

U.S. PATENT DOCUMENTS 3,183,388 5/1965 Townsend et al. ..... 313/451

3,560,779 2/1971 May ..... 313/414

*Primary Examiner*—Sandra L. O'Shea

*Attorney, Agent, or Firm*—Keck, Mahin & Cate

[57] ABSTRACT

A dust collector for collecting dust in a cathode ray tube includes collecting parts which form a collecting space for collecting dust in the cathode ray tube. One of the collecting parts is formed by a retainer for retaining the collecting parts in the cathode ray tube. The dust collector improves the internal voltage characteristics of the CRT and the picture quality.

1 Claim, 2 Drawing Sheets

DUST COLLECTOR IN A CATHODE RAY TUBE

FIELD OF THE INVENTION

The present invention concerns a dust collector for collecting dust in a cathode ray tube (CRT) in order to improve the internal voltage characteristics and picture quality of the cathode ray tube.

TECHNICAL BACKGROUND

Generally, a CRT displays video signals on a screen by moving an electron beam across the screen. The CRT includes a front panel provided with a shadow mask, a frame for supporting the shadow mask and a rear panel for enclosing an electron gun. The CRT also includes a screen coated with phosphor, graphite and oxide. The phosphor, graphite and oxide may be disintegrated by an impact externally undergone during or after the manufacturing process, thus producing dust floating around the shadow mask and in the electron gun with the fourth grid 4 and shield cup 3 as shown in FIG. 1. Such dust adheres to the electrodes (namely, the first to fourth grids) of the electron gun, which have a voltage difference of several hundred volts, so as to short them or cause an undesirable electric discharge. Furthermore, such dust obstructs the apertures of the shadow mask so as to prevent the electron beam from reaching the screen, so that the internal voltage characteristics of the CRT are degraded together with the picture quality. For reference, the second to fourth grids of the electron gun have 600 V, 6 to 7 KV, and 25 KV, respectively In order to resolve this problem, a mechanical vibration is applied to the bulb portion near the neck or the CRT or an air jet is applied to the inside of the CRT so as to remove the dust before inserting the electron gun into the neck. Nevertheless, the dust is not completely removed and, in addition, more dust is produced due to an impact externally applied after finishing the CRT, thus degrading the internal voltage characteristics as well as the picture quality.

SUMMARY OF THE INVENTION

It is an object of the present invention to provide a dust collector for collecting the dust in a CRT in order to improve the picture quality.

According to the present invention, the dust collector for collecting dust in a cathode ray tube comprises a collecting means with a collecting space for collecting dust in the cathode ray tube, and a retaining means for retaining the collecting means in the cathode ray tube.

The present invention will now be described more specifically with reference to the drawings attached only by way of example.

BRIEF DESCRIPTION OF THE ATTACHED DRAWINGS

DETAILED DESCRIPTION OF THE PREFERRED EMBODIMENT

Figure 1:
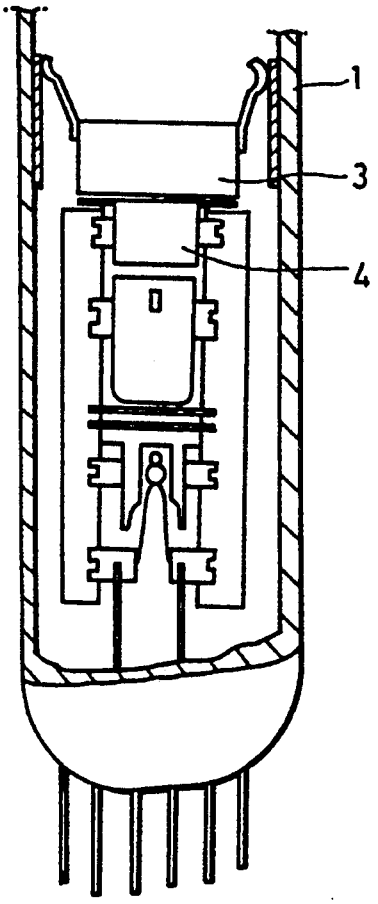
FIG. 1 is a cross sectional view of the essential part of an electron gun embedded in the neck portion of a conventional CRT.
Figure 2A:
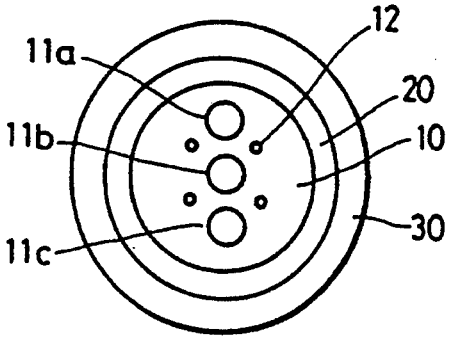
FIGS. 2A and 2B are, respectively, a plan view and a longitudinal section view of a dust collector for a CRT according to an embodiment of the present invention.
Figure 2B:
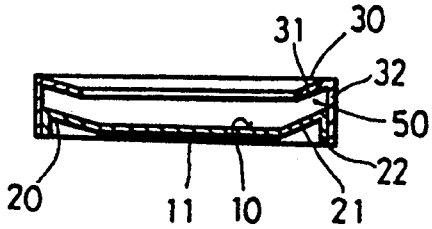

Referring to FIGS. 2A and 2B, there is shown a dust collector with a disk-shaped retaining means 10 adapted for holding the shield cup of the electron gun according to one embodiment of the present invention. The retaining means 10 includes a center portion 11 with three beam apertures 11*a*, 11*b* and 11*c* formed in a straight line on the center thereof for respectively passing the red electron beam (R beam), green electron beam (G beam) and blue electron beam (B beam). Further, the retaining means 10 has four position aligning apertures 12 which are arranged to form a rectangle around the center thereof.

The dust collector comprises a lower collecting part 20 with a first ring-shaped sloping surface 21 inclining outwardly and upwardly from the perimeter of the retaining means 10. The lower collecting part 20 is additionally provided with a first cylindrically shaped side wall 22 extending downwardly from the perimeter of the first sloping surface 21.

The dust collector further comprises an upper collecting part 30 with a second side wall 32 attached to the outside surface of the first side wall 22 and a second ring-shaped sloping surface 31 extending inwardly and downwardly from the upper end of the second side wall 32. In this case, the second sloping surface 31 has a width the same as or smaller than the first sloping surface 21 so as to form a ring-shaped gap between the outside wall of the shield cup and the second sloping surface 31. Also the second side wall 32 has a height greater than the first wall 22 so as to form a dust collecting space between the first and second sloping surfaces 21 and 31.

Figure 3A:
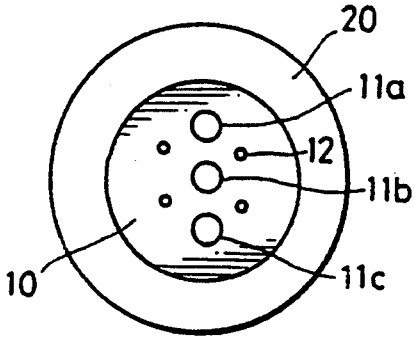
FIGS. 3A and 3B are, respectively, a plane view and a longitudinal section view of a dust collector for a CRT according to another embodiment of the present invention.
Figure 3B:
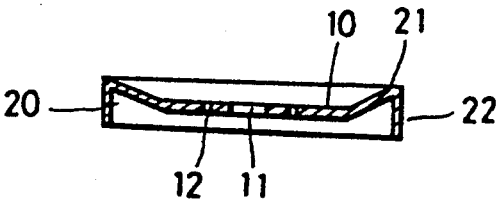

There is shown in FIGS. 3A and 3B a dust collector comprising a retaining means 10 and lower collecting part 20 with the same structure as in FIGS. 2A and 2B, according to another embodiment of the present invention.

Figure 4:
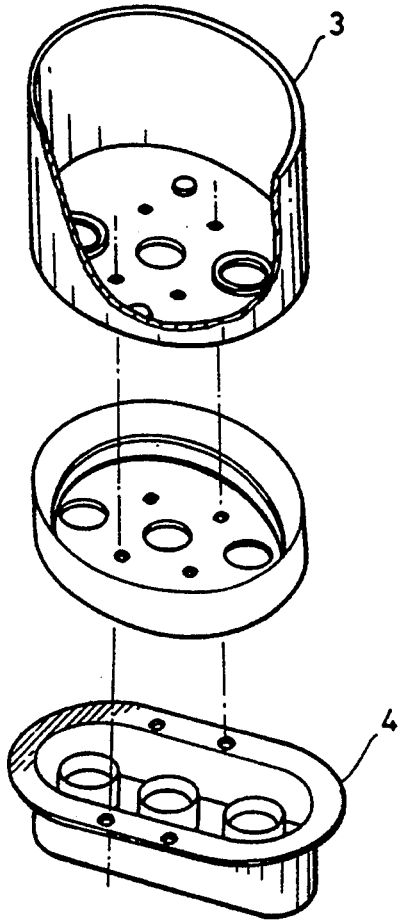
FIG. 4 is an exploded view for illustrating the steps of assembling the dust collector of FIGS. 2A and 2B into the electron gun.

Referring to FIG. 4, there will be described the steps of assembling the dust collector of FIGS. 2A and 2B between the shield cup 3 and the fourth grad 4 of the electron gun. The four position aligning apertures 12 and three beam apertures 11*a*, 11*b* and 11*c* of the dust collector are aligned with those of the shield cup 3 and fourth grid 4.

Figure 5:
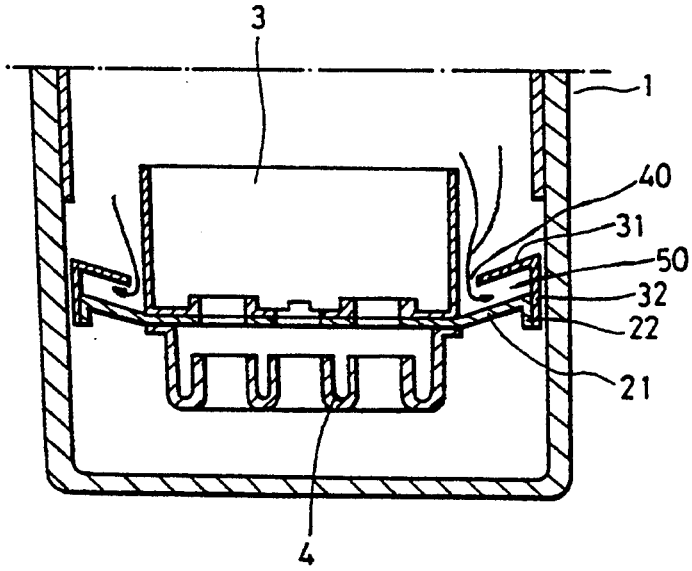
FIG. 5 is a cross sectional view of the essential part of the electron gun with the dust collector, according to the present invention.

In FIG. 5, an essential part of electron gun having the dust collector is shown.

In FIG. 5, the upper and lower collecting parts 30 and 20 are positioned between the outside surface of the shield cup 3 and the inside wall 1 of the electron gun. Between the upper collecting part 30 and the outside surface of the shield cup 3 is formed a gap 40 to provide a passage for the duct to flow into the collecting space 50. The floating dust collected in the collecting space 50 is prevented by the upper and lower collecting parts 30 and 20 from moving towards the shadow mask and the lower electrode of the electron gun.

As stated above, the dust collector of the present invention collects the floating dust between the shield cup and the fourth grid so as to prevent the dust from short-circuiting the electrodes of the electron gun and closing the apertures of the shadow mask, thus improving the internal voltage characteristics together with the picture quality.

What is claimed is:

1. A dust collector for collecting dust in a cathode ray tube comprising an electron gun, a shield cup and a fourth grid, said dust collector comprising:

a disk shaped retaining means, positioned between the shield cup of the electron gun and the fourth grid, for retaining said shield cup, the retaining means including a center portion with three beam apertures and four position aligning apertures, said disk shaped retaining means additionally including a first ring-shaped sloping surface and a first cylindrically shaped side wall, said first sloping surface being inclined outwardly and upwardly from a perimeter of said center portion, said first side wall extending downwardly from the perimeter of the center portion; and an upper collecting part consisting of a second side wall and a second ring-shaped sloping surface, said second side wall being engaged with and attached to the outside surface of the first cylindrically shaped side wall, said second sloping surface extending inwardly and downwardly from an upper end of the second side wall;

wherein said second sloping surface has a width which is no larger than that of said first sloping surface and said second side wall has a height greater than that of said first side wall so as to form a dust collecting space between said first and second sloping surfaces.

* * * * *